US010172767B2

(12) United States Patent
Hyslop

(10) Patent No.: US 10,172,767 B2
(45) Date of Patent: Jan. 8, 2019

(54) TEETHING MITT

(71) Applicant: Melissa Hyslop, Burlington (CA)

(72) Inventor: Melissa Hyslop, Burlington (CA)

(73) Assignee: Melissa Hyslop, Burlington (CA)

( * ) Notice: Subject to any disclaimer, the term of this patent is extended or adjusted under 35 U.S.C. 154(b) by 202 days.

(21) Appl. No.: 15/395,322

(22) Filed: Dec. 30, 2016

(65) Prior Publication Data

US 2018/0055741 A1 Mar. 1, 2018

Related U.S. Application Data

(60) Provisional application No. 62/275,974, filed on Jan. 7, 2016.

(51) Int. Cl.

| | |
|---|---|
| ***A61J 17/00*** | (2006.01) |
| ***A61J 17/02*** | (2006.01) |
| ***A41D 19/00*** | (2006.01) |
| ***A41D 19/01*** | (2006.01) |

(52) U.S. Cl.

CPC ..... *A61J 17/02* (2013.01); *A41D 19/0006* (2013.01); *A41D 19/0024* (2013.01); *A41D 19/0048* (2013.01); *A41D 19/01* (2013.01); *A61J 17/007* (2015.05)

(58) Field of Classification Search

CPC ..... A61J 17/00–17/02; A41D 19/001; A41D 19/0034–19/0041; A41D 19/0051–19/01505; A41D 19/0006; A41D 19/0058; A41D 19/0079; A41D 19/0089; A41D 19/02; A41D 19/0052; A41D 19/0024; A41D 19/01558; A41D 19/0157; A41D 19/01579

See application file for complete search history.

(56) References Cited

U.S. PATENT DOCUMENTS

| | | | | |
|---|---|---|---|---|
| 1,940,728 | A | 12/1933 | O'Connor | |
| 2,279,100 | A | 4/1942 | Worth et al. | |
| D156,590 | S | 12/1949 | Whittaker | |
| 3,690,324 | A * | 9/1972 | Spivack | A61J 17/02 446/397 |
| D288,235 | S | 2/1987 | Hope et al. | |
| 5,052,057 | A | 10/1991 | Fetner | |
| D376,445 | S | 12/1996 | Driggers | |
| D377,053 | S | 12/1996 | Williams | |
| D418,660 | S | 1/2000 | Ke | |
| D463,629 | S | 9/2002 | Black | |
| D509,628 | S | 9/2005 | Gilbert, Jr. | |
| D517,742 | S | 3/2006 | Goldwire | |
| D519,684 | S | 4/2006 | Simic | |
| D526,096 | S | 8/2006 | Kaposi | |

(Continued)

FOREIGN PATENT DOCUMENTS

| | | |
|---|---|---|
| CA | 156684 | 2/2015 |

*Primary Examiner* — Darwin P Erezo
*Assistant Examiner* — Jonathan A Hollm

(57) ABSTRACT

A teething mitt, including a glove portion and a teething cap portion. The glove portion is made of fabric, is flexible, and is adapted to fit over the hand of a child. The teething cap portion is made of silicone and extends over and is secured to the glove portion. A securing strap extends around the glove portion and is used to secure the glove portion near the wrist of the child. The teething cap has protuberances that may be safely chewed upon by the child while teething.

17 Claims, 7 Drawing Sheets

(56) References Cited

U.S. PATENT DOCUMENTS

| | | | | |
|---|---|---|---|---|
| D528,251 | S | 9/2006 | Lion et al. | |
| D547,009 | S | 7/2007 | Shamoon | |
| D551,397 | S | 9/2007 | Van Haren | |
| D588,706 | S | 3/2009 | Williams | |
| D593,278 | S | 6/2009 | Kimm | |
| D638,547 | S | 5/2011 | Peavey | |
| D713,968 | S | 9/2014 | Hyslop | |
| D742,018 | S | 10/2015 | Frazier | |
| D750,791 | S | 3/2016 | Hardisty | |
| D750,792 | S | 3/2016 | Darnley et al. | |
| 2004/0025226 | A1* | 2/2004 | Jaeger | A41D 19/01558 2/161.6 |
| 2005/0177923 | A1 | 8/2005 | Simic | |
| 2005/0222621 | A1 | 10/2005 | Duwelius et al. | |
| 2006/0004412 | A1 | 1/2006 | Gilbert, Jr. | |
| 2007/0016253 | A1* | 1/2007 | Doherty | A61J 17/02 606/235 |
| 2009/0118763 | A1 | 5/2009 | Abramson | |
| 2009/0143822 | A1 | 6/2009 | Perry | |
| 2010/0304636 | A1* | 12/2010 | Seiz | A63H 3/003 446/72 |
| 2011/0224730 | A1* | 9/2011 | Holley | A61J 17/007 606/236 |
| 2012/0016416 | A1 | 1/2012 | Frazier | |
| 2012/0283774 | A1 | 11/2012 | Cudworth et al. | |
| 2015/0209240 | A1* | 7/2015 | Steward | A61J 17/02 606/235 |

* cited by examiner

TEETHING MITT

CROSS REFERENCES AND RELATED SUBJECT MATTER

This application is a non-provisional filing of provisional patent application Ser. No. 62/275,974, filed in the United States Patent Office on Jan. 7, 2016, which is incorporated by reference herein in its entirety.

TECHNICAL FIELD

The present disclosure relates generally to a teething mitt. More particularly, the present disclosure relates to a mitt that includes a glove portion that is adapted to be worn by a child, and has a teething portion attached thereto.

BACKGROUND

At an early age, children begin to experience "teething" when their first set of teeth begin to break through their gums. Generally teething starts at an age of 6 to 8 months, but can begin as early as 3 months. Teething pain often begins 3 to 5 days before the tooth emerges from the gums, and typically involves soreness and swelling of the gums. Because teething can be quite painful, most teething children naturally put things in their mouth to chew on in an attempt to relieve pressure on the gums and soothe the pain.

In addition to household items commonly given to teething children, a variety of devices and products have been proposed in an attempt to provide an ideal device for aiding a child while teething. The common teething ring is a soft plastic item that is held by the child and chewed upon. Since it is typically held by the child, it isn't long before the teething ring, and other similar items, are dropped on the floor and become soiled or lost.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a child with a safe object to teethe upon that can remain with the child for an extended period of time. Accordingly, the present disclosure provides a teething mitt that includes a glove portion that securely attaches onto the hand of a child, and includes a teething cap that can be safely placed by the child in his or her mouth.

It is another aspect of an example embodiment in the present disclosure to provide a teething device that is not easily dropped by the child or lost. Accordingly, because the glove portion remains attached to the child's hand, the teething cap attached thereto is always conveniently available to the child, without requiring that the child exert any effort to hold on to the same.

It is yet another aspect of an example embodiment in the present disclosure to provide a teething device that is safe, comfortable, and entertaining for the child to wear. Accordingly, the glove portion may be constructed of multiple layers that prevent moisture infiltration and may include a crinkle layer for providing audible feedback as the child moves his fingers. In addition, the teething cap is preferably made of silicone, which is safe, durable, and configured for easing the pain associated with teething.

Accordingly, the present disclosure describes a teething mitt, including a glove portion and a teething cap portion. The glove portion is made of fabric, is flexible, and is adapted to fit over the hand of a child. The teething cap portion is made of silicone and extends over and is secured to the glove portion. A securing strap extends around the glove portion and is used to secure the glove portion near the wrist of the child. The teething cap has protuberances that may be safely chewed upon by the child while teething.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
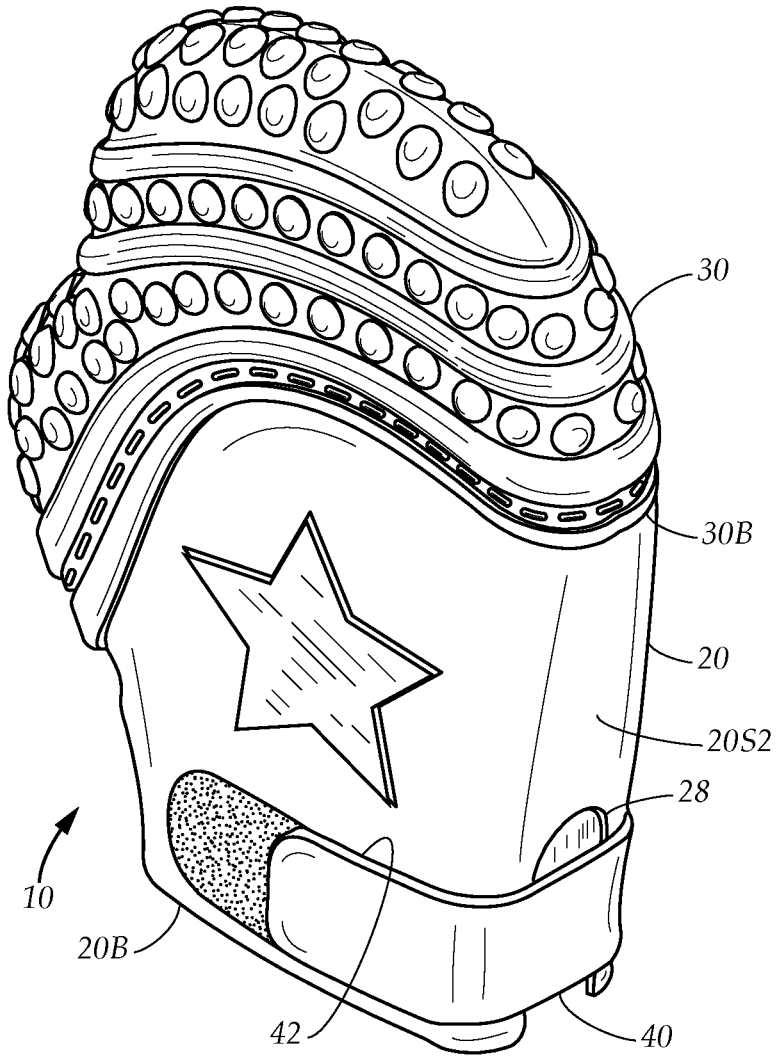
FIG. 1 is a diagrammatic perspective view, illustrating a teething mitt, per se.

FIG. 1 illustrates a teething mitt 10, having a glove portion 20 and a teething cap 30. The glove portion 20 has a bottom 20B, and the teething cap 30 has a bottom edge 30B and a top 30T. The teething cap 30 extends over the glove portion 20 wherein the glove portion 20 is concealed up to the bottom edge 30B, wherein the glove portion 20 is secured to the teething cap 30 near the bottom edge 30B.

Figure 4:
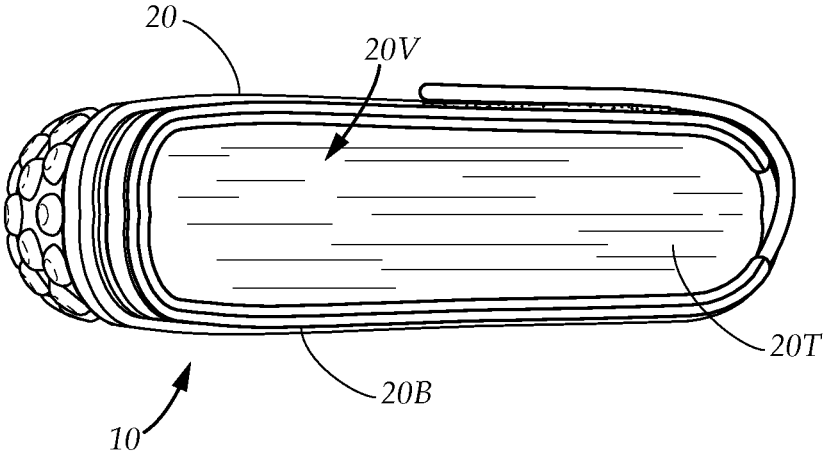
FIG. 4 is a bottom plan view of the teething mitt.
Figure 5:
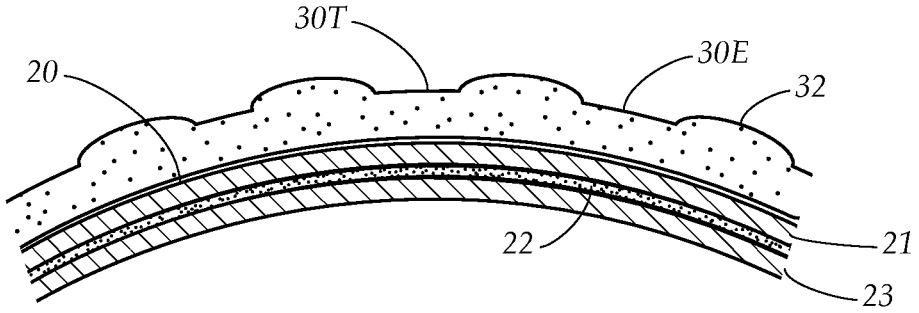
FIG. 5 is a cross sectional view, illustrating the layered construction of the glove portion and the teething cap.
Figure 7:
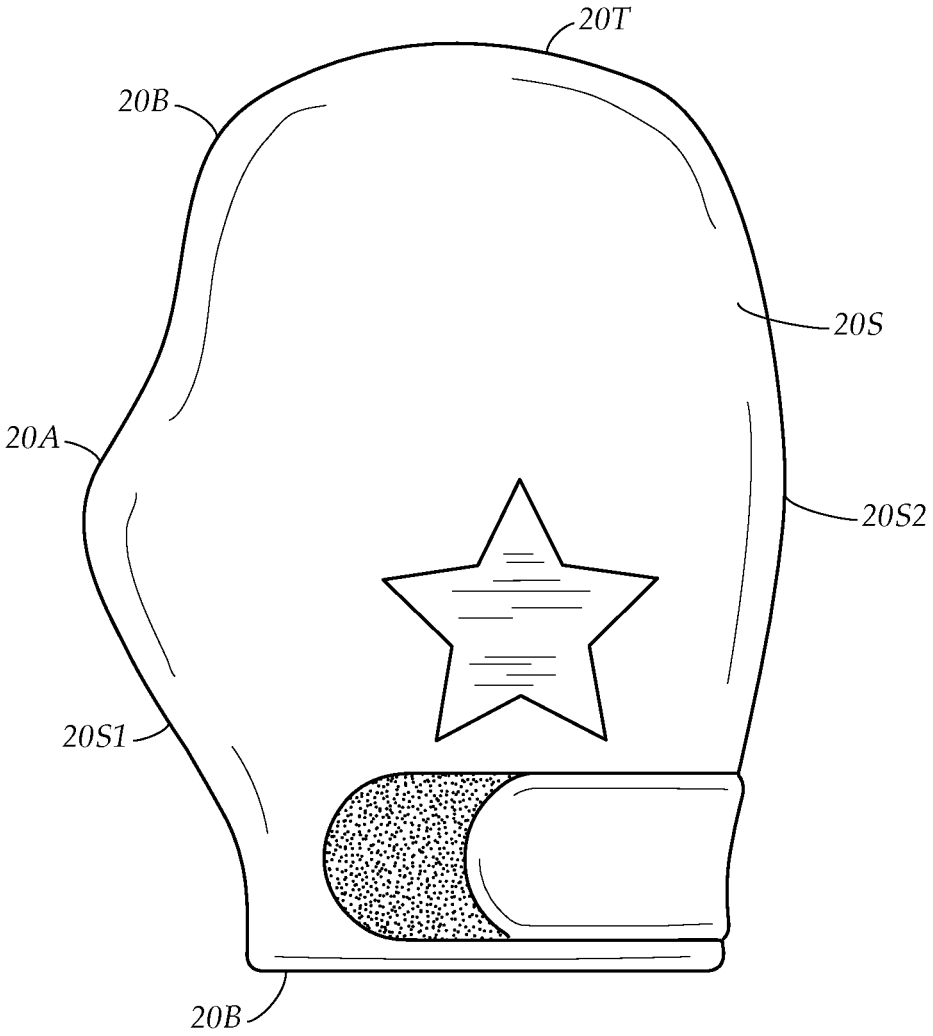
FIG. 7 is a front elevational view, illustrating just the glove portion.

Referring to FIG. 7, the glove portion 20 has a top 20T and a side wall 20S that extends between the top 20T and bottom 20B and generally defines a closed form sized and configured for fitting on the hand of a young child (infant). The side wall 20S includes a first side 20S1 and an opposite second side 20S2. The first side 20S1 may include a thumb indenture 20A for accommodating a child's thumb. The thumb indenture 20A also delineates a main portion 20B extending thereabove for containing other fingers of the child in a configuration most typically found in a mitten. The glove portion 20 preferably contains a multiple layered construction, such as illustrated in FIG. 5, having an outer layer 21 and an inner layer 23 that are made of a fabric material, natural or synthetic, that has the general properties of a textile material. The use of outer and inner layers 21, 23 helps provide a moisture barrier. In addition, a crinkle layer 22 can be provided between the outer 21 and inner layer 23. The crinkle layer 22 is made of a cellophane material commonly known as crinkle paper, which extends fully to the top 20T of the glove 20 to provide a crinkling noise when the glove 20 is flexed or fingers are wiggled and moved within the glove 20. Referring to FIG. 4, the glove portion 20 is open at the bottom 20B has an interior volume 20V for accommodating the hand of a child. The interior volume 20V extends substantially from the bottom 20B of the glove 20 to the top 20T (best seen in FIG. 7).

Figure 2:
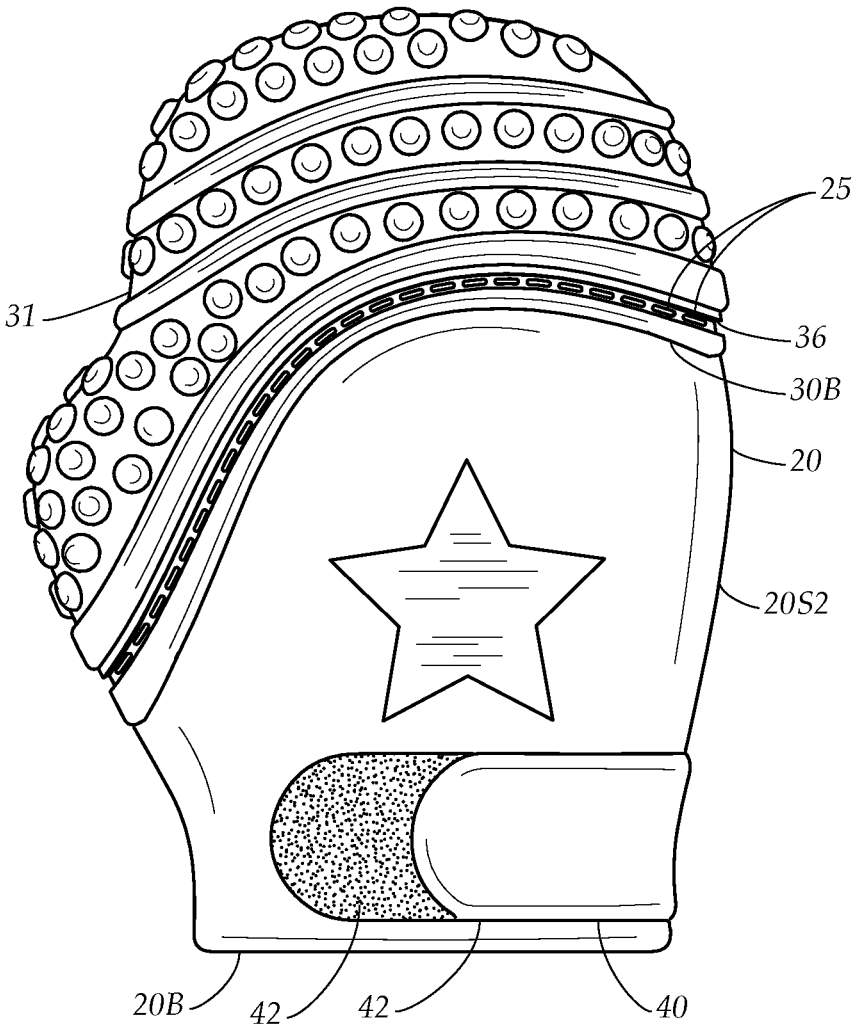
FIG. 2 is a front elevational view, thereof.
Figure 3:
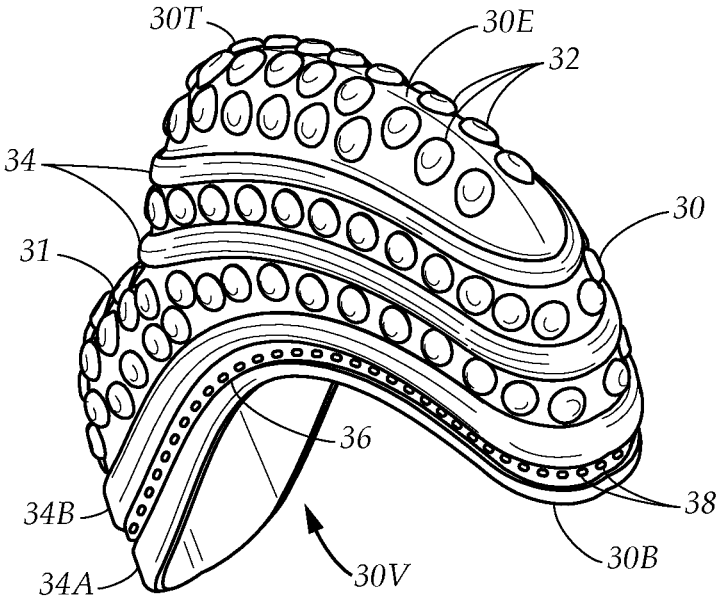
FIG. 3 is a diagrammatic perspective view, illustrating just the teething cap portion thereof.

Referring to FIG. 3, the teething cap 30 includes a cap side wall 30S that extends between the top 30T and the bottom edge 30B, and thereby defines an interior volume 30V therein. The cap 30 is preferably made of silicone and has an exterior surface 30E that includes a plurality of protuberances 32. The protuberances may be provided in a variety of shapes and patterns, as determined through empirical study to ease the pain of the teething child. Further, the teething cap may include a plurality of ribs 34 that extend generally horizontally, providing contour bands between the top 30T and bottom edge 30B. The ribs 34 include a lowermost rib 34A along the bottom edge 30B, and a second rib 34B just above the lowermost rib 34A and defining a stitching channel 36 therebetween. The stitching channel 36 may include stitching apertures 38 that facilitate connection to the glove portion as will be described hereinbelow. The bottom edge 30B of the teething cap 30 has a generally irregular curve, and the side wall 30S may include an indenture 31 (see FIG. 2 also) that reduces the profile of the cap 30 at the top 30T and allows the child to place the cap 30 in his or her mouth as desired for teething. The indenture 31 corresponds with the thumb indenture 20A (see FIG. 7) of the glove portion. The teething cap 30 is constructed to be durable and withstand chewing, and is thereby constructed of silicone material that is sufficiently thick and has an appropriate hardness to avoid puncturing, tearing or cutting therefrom. Silicone with a shore harness rating of "30 to 40 shore A" is preferred for the teething cap 30, and silicone within the range of "20 to 60 shore A" is generally acceptable therefor.

Referring to FIGS. 1 and 2, a securing strap 40 is attached to the glove 30 and extends substantially parallel to the bottom 20B of the glove 20. The securing strap 40 has fastener material 42, as does the glove 20 near the bottom 20B, to allow the strap 40 to be pulled tight, and then suitably positioned and fastened using the fastener material 42. A venting slit 28 is preferably provided along the second side 20S2 of the glove 20, to provide breathability and ensure comfort to the child when the mitt 10 is worn for extended periods of time.

Referring to FIG. 2, the teething cap 30 is preferably stitched to the glove portion 20 near the bottom edge 30B with stitches 25 extending within the stitching channel 36. This manner of connection provides a secure connection between the teething cap 30 and glove portion 20, yet allows independent movement and freedom of the hand within the mitt 10. Note in FIG. 5, in the area illustrated near the top 30T of the teething cap 30, the protuberances 32 are provided to the child on the exterior surface 30E thereof. The glove 20, however, preferably remains independent of the cap in this region, as the cap 30 is not attached to the outer layer 21 thereat, such that the child can manipulate the glove 20 within the cap 30 as the child teethes upon the cap 30.

Figure 8:
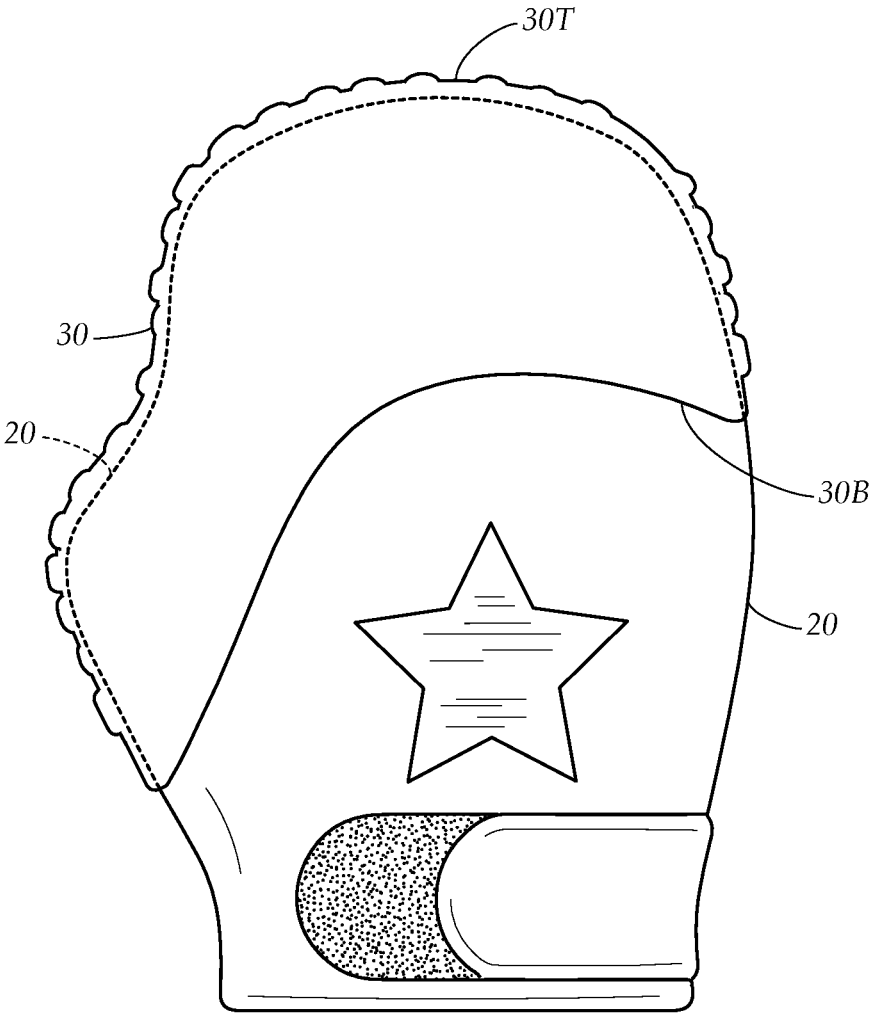
FIG. 8 is a front elevational view, with portions of the teething cap removed for clarity, illustrating the physical arrangement of the glove portion within the teething cap, when mated thereto.

In particular, referring to FIG. 8, the glove 20 extends within the teething cap 30 and may generally closely follow the contours thereof. But since the glove 20 is mainly secured near the bottom edge 30B of the cap 30, portions of the glove 20 that are closer to the top 30T of the cap may move freely therein. In addition, portions of the glove 20 that are below the bottom edge 30B may move as freely as its cloth/fabric/textile construction permits. This freedom of movement allows a child to still move fingers and to receive feedback through the crinkle layer that, as discussed hereinabove, may form a portion of the glove.

Figure 6:
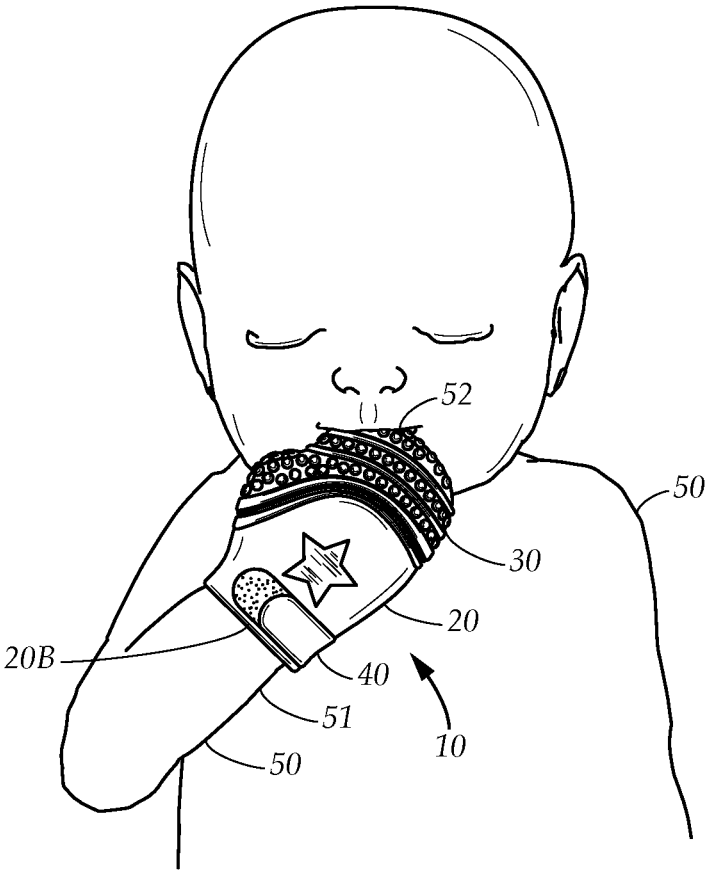
FIG. 6 is a diagrammatic perspective view, illustrating the teething mitt with the glove portion attached on the hand of a child, and the teething cap in the mouth of the child.

Referring now to FIG. 6, a child 50 is wearing the teething mitt 10. The child has a hand 50 having a wrist 51, and has a mouth 52. The hand 50 is inserted fully into the mitt 10 through the bottom 20B of the glove 20 up to the wrist 51, and the securing strap 40 is tightened around or near the wrist 51. As illustrated, the child 50 has placed the teething cap 30 in his mouth 52 and is chewing thereupon to ease the discomfort associated with teething.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a teething mitt. The disclosure is illustrated by example in the drawing figures, and throughout the written description. It should be understood that numerous variations are possible, while adhering to the inventive concept. Such variations are contemplated as being a part of the present disclosure.

What is claimed is:

1. A teething mitt comprising:

a glove portion having a top and bottom, the glove portion made of flexible fabric and open at the bottom to receive a child's hand up to the wrist;

a teething cap comprising:

a top;

a bottom edge;

a side wall between the top and the bottom edge that defines an interior volume, the teething cap extending over and attached to the glove portion near the bottom edge of the teething cap such that the glove portion extends within the interior volume of the teething cap and is concealed from the top of the glove portion to the bottom edge of the teething cap;

a lowermost rib extending along the bottom edge;

a second rib extending above the lowermost rib substantially parallel to the lowermost rib; and a stitching channel extending between the lowermost rib and the second rib; and stitching within the stitching channel to attach the teething cap to the glove portion, wherein attachment of the teething cap to the glove along the bottom edge of the teething cap allows the glove above the bottom edge of the teething cap to move independently of the teething cap inside the teething cap.

2. The teething mitt of claim 1, wherein the glove portion has an inner layer made of fabric, an outer layer made of fabric, and a crinkle layer made of cellophane extending between the inner layer and outer layer for making a crinkling noise as the glove portion is flexed and moved.

3. The teething mitt of claim 1, wherein the teething cap has an exterior surface comprising a plurality of protuberances.

4. The teething mitt of claim 1, wherein the glove portion has a first side with a thumb indenture and a second side with a venting slit.

5. The teething mitt of claim 1, further comprising a securing strap that extends around the glove portion substantially parallel to and near the bottom of the glove portion for securing the glove portion near the wrist of the child.

6. The teething mitt of claim 1, further comprising a plurality of ribs extending generally horizontally to the bottom edge of the teething cap.

7. The teething mitt of claim 1, wherein the teething cap is made of silicone.

8. The teething mitt of claim 7, wherein the silicone has a shore hardness rating of 20 to 60 shore A.

9. A teething mitt comprising:

a glove portion having a top and a bottom, a first side and an opposite second side, the first side comprising a thumb indenture adapted for accommodating a child's thumb, the second side delineating a main portion adapted for receiving fingers other than the thumb, the glove portion made of flexible fabric and open at the bottom to receive the child's hand up to the wrist; and a teething cap comprising a top and a bottom edge and a side wall therebetween that defines an interior volume, the side wall comprising an indenture that corresponds with the thumb indenture on the glove portion, the teething cap extending over and attached to the glove portion near the bottom edge of the teething cap such that the glove portion extends within the interior volume of the teething cap and is concealed from the top of the glove portion to the bottom edge of the teething cap, the teething cap comprising a lowermost rib extending along the bottom edge, a second rib extending above the lowermost rib substantially parallel to the lowermost rib, a stitching channel extending between the lowermost rib and the second rib, and stitches within the stitching channel that connect the teething cap to the glove portion, wherein the attachment of the teething cap to the glove along the bottom edge of the teething cap allows the glove above the bottom edge of the teething cap to flex and move independently of the teething cap inside of the teething cap.

10. The teething mitt of claim 9, wherein the glove portion has an inner layer made of fabric, an outer layer made of fabric, and a crinkle layer extending between the inner layer and the outer layer, for making a crinkling noise as the glove portion is flexed and moved.

11. The teething mitt of claim 9, wherein the teething cap has an exterior surface that includes a plurality of protuberances, and wherein some of the protuberances extend between at least two of the ribs.

12. The teething mitt of claim 11, wherein the second side of the glove portion has a venting slit.

13. The teething mitt of claim 9, wherein the bottom edge of the teething cap has an irregular curve to accommodate the thumb indenture.

14. The teething mitt of claim 9, further comprising a securing strap that extends around the glove portion substantially parallel to and near the bottom of the glove portion for securing the glove portion near the wrist of the child.

15. The teething mitt of claim 9, further comprising a plurality of ribs extending generally horizontally to the bottom edge of the teething cap providing contour bands between the bottom edge and top of the teething cap.

16. The teething mitt of claim 9, wherein the teething cap is made of silicone.

17. The teething mitt of claim 16, wherein the silicone has a shore hardness rating of 20 to 60 shore A.

* * * * *